United States Patent [19]

Reisenfeld

[11] Patent Number: 4,882,589

[45] Date of Patent: Nov. 21, 1989

[54] COHERENT SWITCHING SYSTEM FOR A MULTIPLE BEAM ANTENNA

[75] Inventor: Sam Reisenfeld, Playa del Rey, Calif.

[73] Assignee: Hughes Aircraft Company, Los Angeles, Calif.

[21] Appl. No.: 947,459

[22] Filed: Dec. 29, 1986

[51] Int. Cl.[4] ..... H01Q 3/02

[52] U.S. Cl. ..... 342/374; 342/375; 455/277

[58] Field of Search ..... 342/374, 375; 455/8, 455/10, 277, 134, 135

[56] References Cited

U.S. PATENT DOCUMENTS

| | | | |
|---|---|---|---|
| 2,494,309 | 1/1950 | Peterson | 455/134 X |
| 3,922,685 | 11/1975 | Opas | 342/374 X |
| 4,234,956 | 11/1980 | Adderley et al. | 455/8 X |
| 4,255,816 | 3/1981 | Grunza et al. | 455/277 |
| 4,328,587 | 5/1982 | Mizuno et al. | 375/118 X |
| 4,499,472 | 2/1985 | Willet | 342/374 |
| 4,626,858 | 12/1986 | Copeland | 342/374 |
| 4,633,519 | 12/1986 | Gotoh et al. | 455/277 |

FOREIGN PATENT DOCUMENTS

| | | | |
|---|---|---|---|
| 0190862 | 8/1986 | European Pat. Off. | 455/277 |
| 0068328 | 4/1983 | Japan | 455/134 |
| 0196627 | 8/1986 | Japan | 455/134 |
| 264482 | 7/1970 | U.S.S.R. | 455/134 |

*Primary Examiner*—Thomas H. Tarcza
*Assistant Examiner*—Tod Swann
*Attorney, Agent, or Firm*—Steven M. Mitchell; Wanda K. Denson-Low

[57] ABSTRACT

A coherent multiple beam antenna switching system is disclosed. The invention is adapted for use with an antenna having a switch for directing a signal through a first feed via a first channel into a output port and for directing a signal received by a second feed into said first channel at a time T. The invention includes a power detection circuit for measuring the power in the signal in the first channel via the first feed and a controller responsive to the measured power for activating the switch prior to time T to direct the signal via the second feed and a second channel to the output port. The controller includes the capability of predicting the switching of feeds and switches in the second channel in anticipation thereof. Phase detection and correction circuits are provided for aligning the signal in the second channel with the signal in the first channel. When the signals are aligned, the channels are switched at baseband to provide for coherent switching with minimal switching transients.

6 Claims, 8 Drawing Sheets

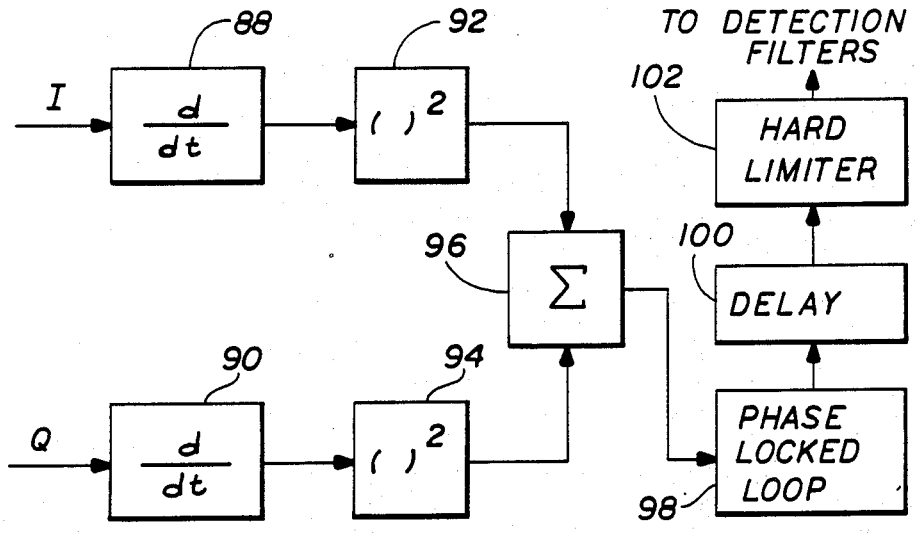
FIG. 3
FIG. 4
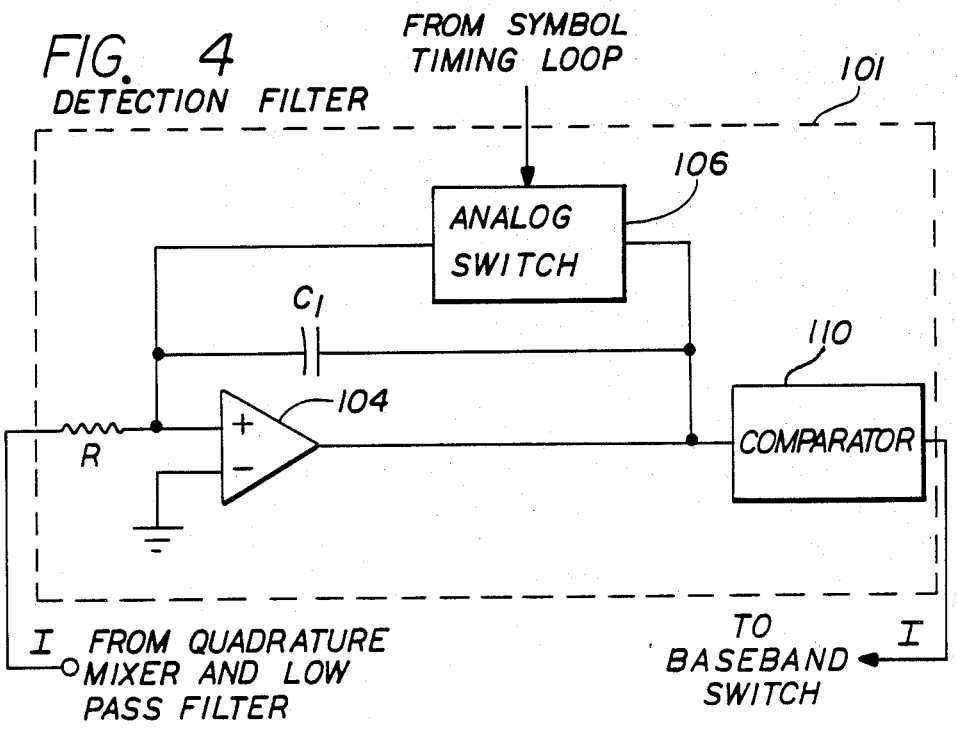

120

6 x 3 DIGITAL SWITCH
160
DATA
DATA
CLK
CHANNEL OUTPUT
CONTROL
AMBIGUITY DETECTOR
140
AMBIGUITY CORRECTION
150
AMBIGUITY CORRECTION
150
CLK
DATA
DATA
DATA
DATA
DATA
CLK
DATA
DATA
CLK
DATA
DATA
CLK
DATA
DATA
CLK
TO CONTROLLER
3N x 6 DIGITAL SWITCH
130
FROM CONTROLLER
FROM DEMOD 1
FROM DEMOD 2
FROM DEMOD N

COHERENT SWITCHING SYSTEM FOR A MULTIPLE BEAM ANTENNA

BACKGROUND OF THE INVENTION

1. Field of the Invention

The present invention relates to communication systems. More specifically, the present invention relates to systems for switching feeds of a multiple beam antenna (MBA).

While the invention is described herein with reference to an illustrative embodiment for a particular application, the invention is not limited thereto. Those of ordinary skill in the art will recognize additional modifications, applications and embodiments within the scope of the invention.

2. Description of the Related Art

The utility of multiple beam antennas in addressing the ever increasing demands on communications payloads is well recognized. Multiple beam antennas (MBAs) are capable of providing plural agile beams for reception and/or transmission. The MBA may consist of a single reflector with multiple feeds or a phased array of feed horns. In either case, the feeds are selectively switched to effectuate beam selection and/or beam steering.

It has been noted that during the switching of feeds, switching transients may occur which may cause a momentary interruption of the communication link. In the case of a coherent receiver, that is, one utilizing a phase modulation scheme, a phase discontinuity may occur during switching. This would result in a loss of phase lock. As phase reqcquisition requires a finite amount of time, a glitch or momentary loss of data may result. It will be readily apparent that such a loss of data would be at least undesirable in most applications and of severe adverse consequences in some applications. There is therefore a need in the art for an improved switching system for coherent multiple beam antennas.

SUMMARY

The shortcomings of the related art are addressed by the coherent multiple beam antenna switching system of the present invention. The invention is adapted for use with an antenna having a switch for directing a signal through a first feed via a first channel into a output port and for directing a signal received by a second feed into said first channel at a time T.

The invention includes a power detection circuit for measuring the power of the signal in the first channel via the first feed and a controller responsive to the measured power for activating the switch prior to time T to direct the signal via the second feed and a second channel to the output port. The controller includes the capability of predicting the switching of feeds and switches in the second channel (typically a second demodulator) in anticipation thereof.

In a specific embodiment, phase detection and correction circuits are provided for aligning the signal in the second channel with the signal in the first channel. When the signals are aligned, the channels are switched at baseband to provide for coherent switching with minimal switching transients.

BRIEF DESCRIPTION OF THE DRAWINGS

FIG. 3 is an illustrative implementation of a symbol timing loop.

FIG. 4 is an illustrative implementation of a detection filter.

FIG. 5(*b*) shows a typical filter output signal.

DESCRIPTION OF THE INVENTION

Figure 1:
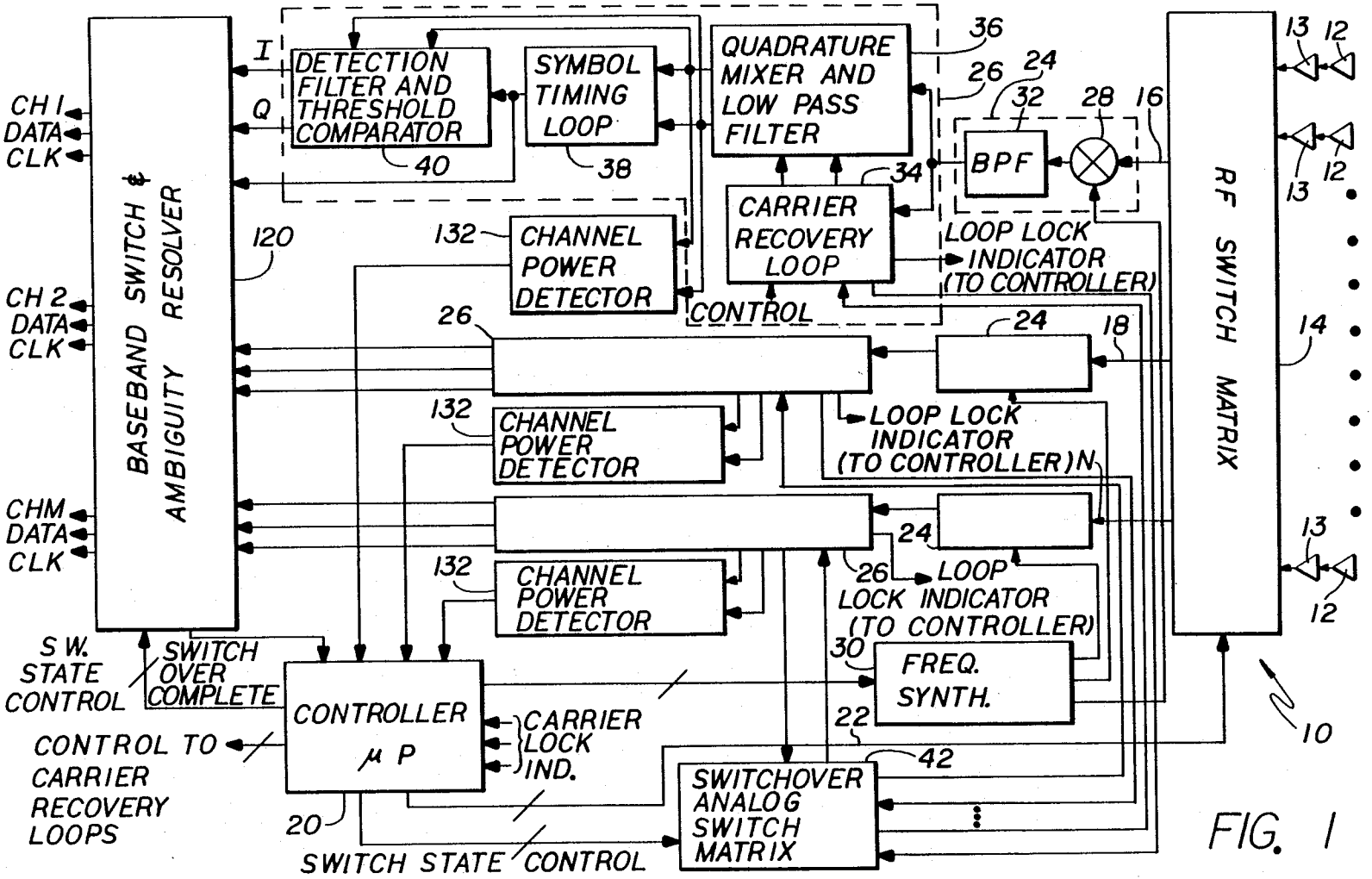
FIG. 1 is a block diagram representation of a coherent multiple beam antenna switching system incorporating the teachings of the present invention.

As described below with reference to the illustrative embodiment shown in the drawings, the present invention provides a coherent multiple beam antenna switching system which effectuates beam selection with minimal switching transients. The invention is adapted for use with a conventional MBA having multiple feeds (e.g. multiple antennas or a phase array) and means for switching from one feed or set of feeds to another at some time T. For a conventional system, the switching may occur at a predetermined time or on the occurrence of a particular signal level. The system for which the present invention would be used would also typically include a downconverter, demodulator, and an output port. Additional channels for downconversion and demodulation may be provided as is known in the art.

The present invention supplements the conventional MBA switching system by providing means for measuring the power of the signal in the first demodulator and a controller for predicting an impending switching operation based on this measured power level. The feed selected in a conventional manner, is switched into a downconversion channel with a second demodulator by the controller prior to time T. The invention includes means for aligning the carrier of the signal received by the selected feeds. Upon phase acquisition and alignment of the signal in the second channel, the output port is switched at baseband from the first channel to the second channel. As the present invention allows the switching operation to occur at baseband between data symbols from one bit stream to a second substantially identical bit stream, switching transients are virtually eliminated.

FIG. 1 shows an operational block diagram of a multiple beam antenna switching system 10 incorporating the teachings of the present invention. For the purpose of illustration, the invention is shown in use with a multiple beam antenna having multiple feeds 12 and low noise amplifiers (LNAs) 13. The LNAs 13 improve the noise figure of the front end and provide the signals received by each feed 12 to an RF switching matrix 14. The switching matrix 14 interconnects selected feeds 12 with n output paths or channels 16 and 18—N in a manner well known in the art. The switch matrix 14 typically includes an array of switching elements (not shown) and operates under a controller 20 via a bus 22. The RF switching matrix 14 is known in the art and may for example be provided by Transco Products Inc. of Camarillo, Calif.

Each channel may include any suitable circuitry or simply a transmission line. In the illustrative embodiment of FIG. 1, each channel 16 includes downconvertors 24 and demodulators 26 as is typical in the art. Each downconvertor 24 includes a mixer 28 which multiplies the RF (radio frequency) signal provided by the preselected feeds 12 with a local oscillator frequency provided by a frequency synthesizer 30. The frequency synthesizer 30 operates under the controller 20 and allows the controller to activate and thereby select any channel or combination of channels. The bandpass filter 32 removes a sum or difference frequency term from the output of the mixer 28 and provides it to the demodulator 26 as an IF (intermediate frequency) signal.

The demodulator 26 includes a carrier recovery loop 34 which feeds quadrature mixers and low pass filters 36, a symbol timing loop 38 and detection filters and threshold comparators 40. The carrier recovery loop 34 and quadrature mixers and low pass filters 36 operate on the received input signal and provide I and Q baseband components. The carrier recovery loop 34 of each channel acquires the carrier from the received signal or from another carrier recovery loop via an analog switch matrix 42 at the direction of the controller 20. The carrier tracking loop frequency switchover analog switch matrix 42 transfers a voltage from the voltage controlled oscillator of one channel to that of a second channel to facilitate the rapid acquisition of carrier. The switch matrix 42 may be implemented in the same manner as the RF switch matrix 14 or any other suitable manner known in the art.

Figure 2:
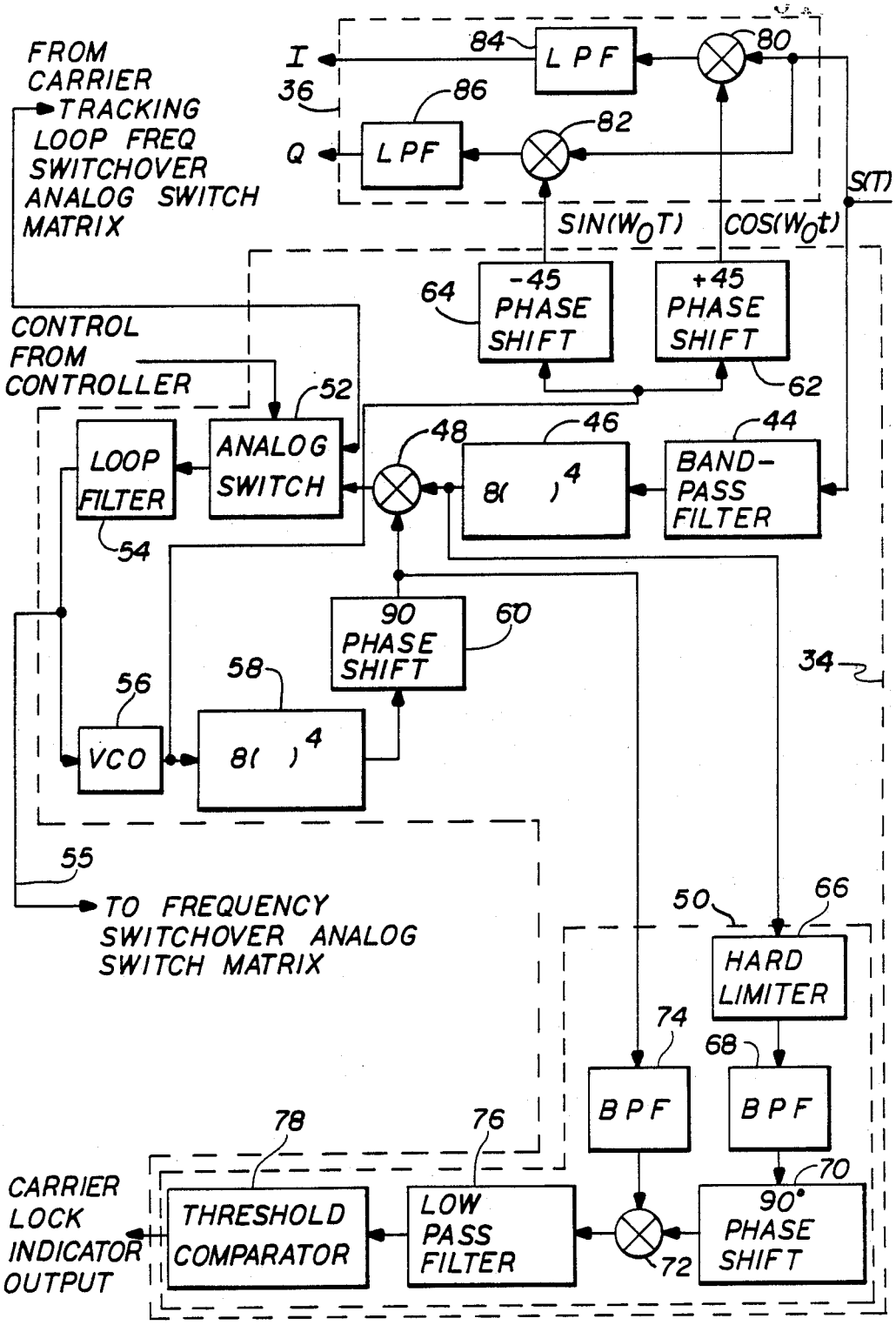
FIG. 2 is a block diagram showing an illustrative implementation of a QPSK carrier recovery loop, loop lock indicator, quadrature mixers and low pass filters.

As shown in FIG. 2, the received input signal S(t) is filtered by a bandpass filter 44 and factored by 8 and raised to the fourth power by an $x^4$ nonlinearity 46. The $x^4$ nonlinearity 46 may be implemented by cascaded multipliers, or by other techniques, as is known in the art. The nonlinearity 46 provides a signal to a mixer 48 which includes no modulation. The output of the mixer 48 is input to an analog switch 52. The analog switch 52 has a second input from the carrier tracking loop frequency switchover analog switch matrix 42. The switch matrix 42 provides an initial frequency to the loop 34 to increase the speed of carrier acquisition. The initial frequency may be provided by the controller 20 during startup or by the carrier recovery loop of the channel that is passing off during operation of the invention. By passing the acquired carrier from the first channel to the second channel, the loop acquisition time of the second channel may be substantially reduced. Thus carrier injection is accomplished by the controller 20 via the analog switch 52 which selects either the output of the mixer 48 or the signal from the analog switch matrix 42 for input to a loop filter 54. The loop filter 54 is of the form of a low pass filter and provides the time dynamics of the loop. The loop filter 54 provides an input to a voltage controlled oscillator (VCO) 56 which generates the recovered carrier $w_o$. The output of the VCO 56 is powered by four and factored by eight by a second nonlinearity 58 then shifted in phase by a 90 degree phase shifter 60 before being input to the mixer 48 to complete the loop. The recovered carrier $w_o$ is output to a pair of positive and negative 45 degree phase shifters 62 and 64, from the VCO 56, to generate the coherent carriers cos ($w_o t$) and sin ($w_o t$) respectively.

As mentioned above, each carrier recovery loop 34 provides a loop lock indication to the controller 20. This is accomplished by feeding the modulation free output from the first nonlinearity 46 to a hard limiter 66 of the illustrative loop lock indicator circuit 50. The hard limiter 66 operates to control the amplitude of the input signal. Bandpass filter 68 rejects products higher than $4w_o$, for the illustrative QPSK implementation of the present invention. A bandpass filter 68 provides a signal representing sin ($4w_o t$) to a 90 degree phase shifter 70. The phase shifter 70 provides a signal representing cos ($4w_o t$) to a mixer 72. The loop lock indicator circuit 50 receives a second input from the output of the loop phase shifter 60. The second bandpass filter 74 rejects the terms higher than $4w_o$ as does the first filter 68. When the loop 34 is phase locked, the bandpass filter 74 provides a signal representing cos ($4w_o t$) as a second input to the mixer 72. When the loop 34 is in lock, the output of the mixer 72 is therefore $\cos^2(4w_o t)$. Since $\cos^2(4w_o t) = \frac{1}{2} + \frac{1}{2}(\cos(8w_o t))$, a low pass filter 76 is provided with a passband that removes the $8w_o t$ term. The analog threshold comparator 78 looks for an output of $\frac{1}{2}$ from the low pass filter 76 to indicate loop lock. That is, the threshold comparator 78 may be set at say $\frac{1}{4}$ volts and provide a logical '1' output if the input is greater than $\frac{1}{4}$ and a logical '0' if the input is less than $\frac{1}{4}$. This signal is provided to the controller 20.

Other outputs of the carrier recovery loop 34 include an output from the loop filter 54 on line 55 to the carrier tracking loop frequency switchover analog switch matrix 42. This line 55 provides a voltage representing the loop tracking frequency for injection to a second channel in the manner discussed above. Also provided for input to quadrature mixers and low pass filters 36 are coherent carrier terms cos ($w_o t$) and sin ($w_o t$).

The typical quadrature mixers and lowpass filter circuit 36 is also shown in FIG. 2. In the quadrature mixer and lowpass filter circuit 36, the coherent carriers provided by phase shifters 62 and 64 are mixed with the received signal S(t) by mixers 80 and 82 and low pass filtered by filters 84 and 86 to obtain the quadrature baseband signal components I and Q respectively. The baseband signal components are provided as inputs to the symbol timing loop 38 of FIG. 1.

The symbol timing loop 38 locks on to the symbol rate and provides the timing signal to the detection filters 40. An illustrative implementation of an adaptive symbol timing loop 38 is shown in FIG. 3. The symbol timing loop 38 includes dual differentiators 88 and 90 which detect the edges of the input pulses and provide corresponding positive and negative pulses representative of the symbol transitions. The squaring circuits 92 and 94 transform the negative pulses from the differentiators 88 and 90 to positive pulses. A summing circuit 96 sums signals representing both the I and Q inputs to generate the strongest frequency component at the symbol rate. The summing circuit 96 provides input to a phase locked loop 98. The phase locked loop 98 provides flywheel continuity of the recovered clock signal when the density of the signal transitions is low. The output of the phase locked loop 98 is delayed by a delaying circuit 100 to synchronize the recovered clock signal with the received signal. Hard limiter 102 squares the clock pulses to provide the recovered clock to the detection filters.

The detection filters 40 receive the I and Q signals respectively from the quadrature mixers and low pass filters circuit 36 and integrate the signals over the symbol period to minimize noise and improve the performance of the system. (The symbol period is the reciprocal of the symbol rate.) Two filters are provided, one for the in-phase signal I and one for the quadrature phase signal Q. As shown in FIG. 4, the detection filter may be implemented by an integrate and dump filter 101. The filter 101 includes an operational amplifier 104 having an input resistor R, a capacitor $C_1$ in a feedback loop, and a second feedback loop with an analog switch 106. The analog switch 106 operates under control of the symbol timing loop 38 to reset or dump the integrator 101 at the symbol rate. Those of ordinary skill in the art will recognize that low pass filters may be used instead of the integrate and dump filters to implement the detection filters for high speed applications where a slight performance degradation may be tolerated.

Figure 5A:
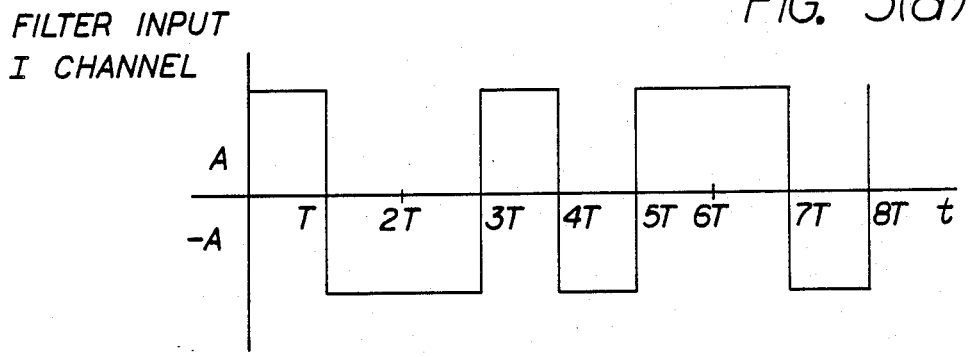
FIG. 5(*a*) shows a typical filter input signal.
Figure 5B:
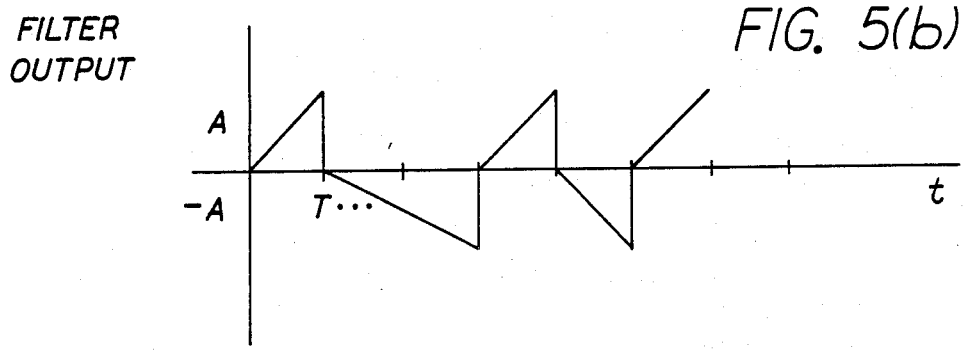

As exemplified in FIG. 5(*a*), the I and Q inputs to the filters 101 are square waves of widths varying in relation to modulation on the carrier signal. As shown in FIG. 5(*b*), the output of the filters 101 is a linear ramp that resets at the end of each symbol period. The output of the filter will grow toward +A or −A until the filter is reset by the symbol timing loop 64. As shown in FIG. 4, a decision comparator 110 is provided for each filter 101 which compares the state of the filter outputs to zero and extracts the modulated signal from the I and Q components. In this QPSK implementation, the I comparator provides a logical '0' or '1' output while the Q comparator similarly provides a logical '0' or '1' output. Thus, the four possible combinations of decision comparator outputs (00, 01, 10, and 11) of the demodulator 26 of each channel provide the four possible states of QPSK signal for input as I and Q signals to the baseband switch and ambiguity resolver 120.

Figure 6:
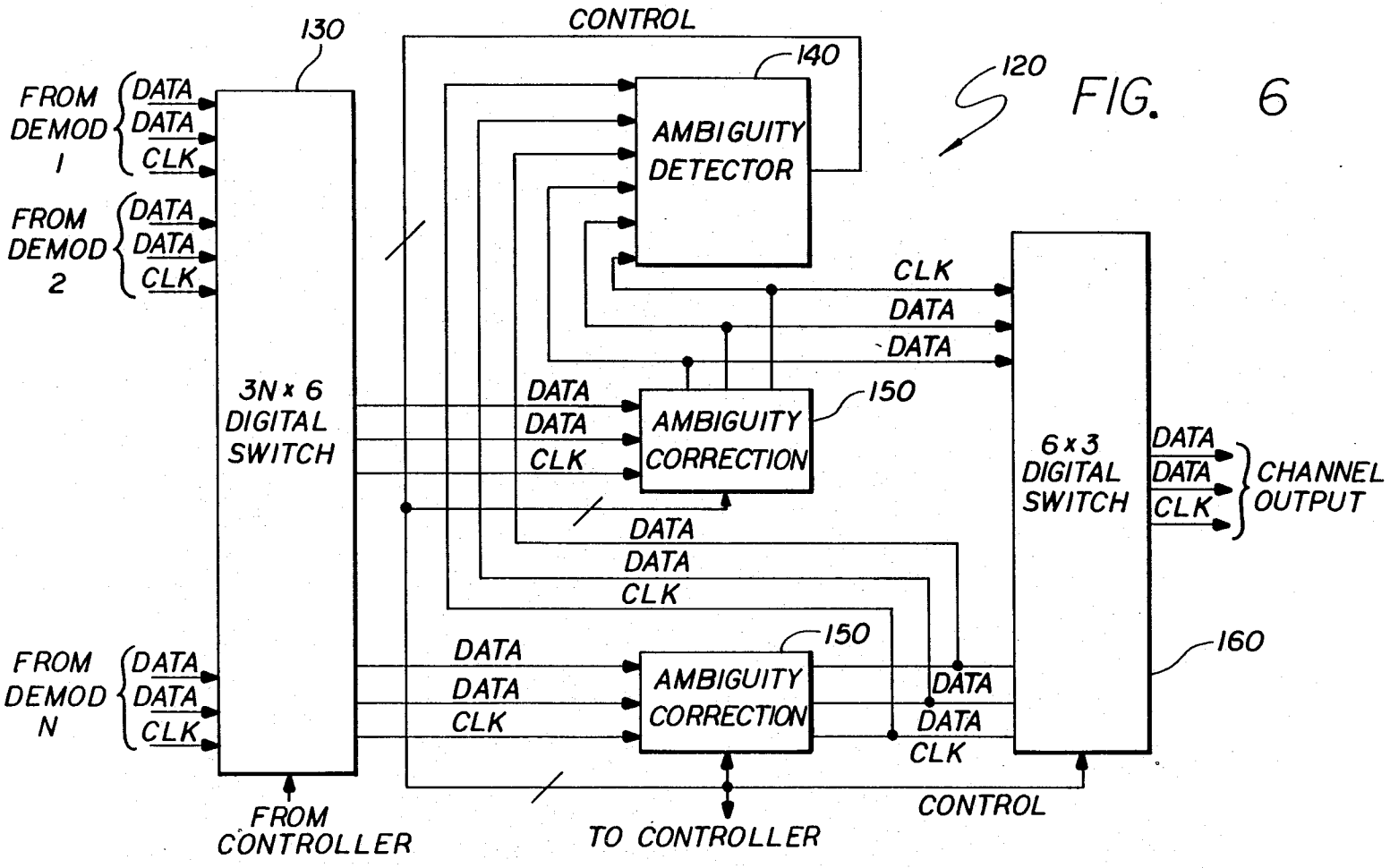
FIG. 6 shows an illustrative implementation of the baseband switch and ambiguity resolver of the present invention.

The baseband switch and ambiguity resolver 120 operates under the controller 20 to align the signals received by two channels, say 16 and 18 and to provide a switchover from one to the other at baseband. The baseband switch and ambiguity resolver 120 is shown diagrammatically in FIG. 6. A digital switch 130 is provided which allows the controller 20 to select two of the N channels for alignment and switchover. The switch 130 is a digitally controlled 3N×6 switch and is known in the art.

As shown in FIG. 1, the controller 20 monitors the power in each channel via a conventional power detector circuit 132 and uses linear predictive filtering techniques to determine which set of fed and channels will be used by the MBA at a switchover time T. That is, in cases where the time dynamic model of the change of angular position of the transmitter is known, the power level measurements from the first channel 16 and the channels attached to adjacent beams may be input into a linear predictive filtering algorithm such as a Kalman filter or a Wiener filter. The predicted power levels are then used by the controller 20 to trigger the switchover operation. (Also, the absolute position of the transmitter and absolute position and attitude of the receiving antenna may be used directly or in a linear predictive filter to trigger a switchover operation by the controller 20.)

Initially, communication is established through the first channel 16 and data is passed through the switch 130, ambiguity correction circuit 150 and a 6×3 output switch 160 without change. See FIG. 6. In advance of the switchover time T, the controller 20 switches a second channel, e.g. 18, through the switch 130 to the amibiguity correction circuit 150 for phase alignment. Phase alignment or ambiguity resolution is provided by an ambiguity detector 140 and the ambiguity correction circuits 150.

Figure 7:
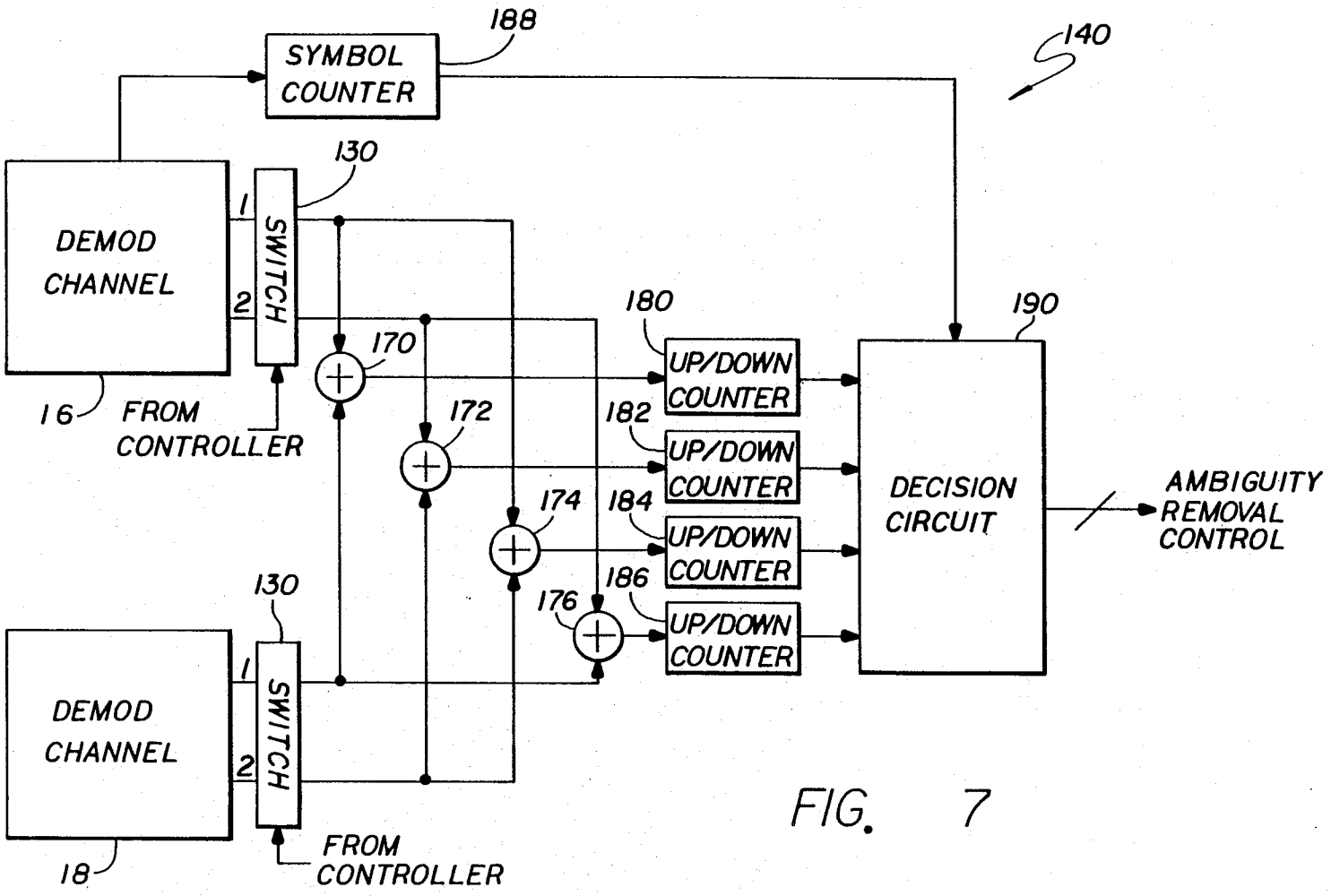
FIG. 7 illustrates diagrammatically, the implementation of ambiguity detector in the present invention.

The ambiguity detection circuit 140 is shown in greater detail in FIG. 7. It includes four exclusive or XOR gates 170–176, four up/down counters 180–186, a symbol counter 188, and a decision circuit 190. The switch 130 allows the controller to select the channels for alignment. In FIG. 7, for the purpose of illustration, the first channel is chosen as channel 16 and the second channel is chosen as channel 18. Each line of each channel is compared to each line of the other channel through the exclusive or gates. When the signals on each line agree, the output of the gate is high and the corresponding counter is incremented. Accordingly, when the two lines disagree, the counter is decremented. The decision circuit 190 looks at the count and decides what the relative phase angle is and what the correction should be. The decision circuit 190 may be implemented by a lookup table in a read only memory (ROM). The ambiguity detection circuit 140 thus performs a bit sequence comparison over several symbols to determine the relative phase of the signals in the two channels. That is, if $D_I$ is on the upper line and $D_Q$ is on the lower line in both cases, the corresponding first and second up/down counters 180 and 182 count up to the threshold. Since there is no correlation between the I and Q lines of each channel, the other counters 184 and 186 remain near zero. By the combinations of counts, the relative phase angle may be identified. For example, assume that data is being received on the first channel 16 and it is desired to make a switchover to the second channel 18. The carrier recovery loop 34 of the second channel 18 may lock to any one of four stable phase lock points and it may not necessarily be the same as the lock point of the carrier recovery loop 34 of the first channel 16. For the purpose of illustration, assume that the I data output is defined as that on line 1, the Q data output is defined as that on line 2 and that the carrier recovery loop of the first channel 16 locks to 0 radians. Table I indicates the line 1 and line 2 outputs of the second channel 18 as dependent upon the lock point of the carrier recovery loop 34 of the second channel 18.

TABLE I

| Lock Point | Line 1 Output | Line 2 Output |
|---|---|---|
| 0 | $D_I$ | $D_Q$ |
| (pi/2) | $-D_Q$ | $D_I$ |
| (pi) | $-D_I$ | $-D_Q$ |
| (3pi/2) | $D_Q$ | $-D_I$ |

Under the generally valid assumption that the I channel is uncorrelated with the Q channel data, the following is immediately observable. For the lock point of the carrier recovery loop 34 of the second channel 18 at zero radians with respect to the lock point of the first channel 16, lines 1 of the first channel and the second channel are positively correlated and lines 2 of the two channels are positively correlated, while lines 1 and 2 from different channels respectively, are uncorrelated. For the lock point of the carrier recovery loop of the second channel at pi/2 radians with respect to the first channel, line 1 of the first channel and line 2 of the second channel are positively correlated, line 2 of the first channel and line 1 of the second channel are negatively correlated, lines 1 of the two channels are uncorrelated, and lines 2 of the two channels are uncorrelated. For the lock point of the second channel at pi radians with respect to the lock point of the first channel, lines 1 of the two channels are negatively correlated, lines 2 of the two channels are negatively correlated, line 1 of the first channel and line 2 of the second channel are uncorrelated, and line 2 of the first channel and line 1 of the second channel are uncorrelated. For the lock point of the second channel at 3 pi/2 radians with respect to the lock point of the first channel, line 1 of the first channel and line 2 of the second channel are negatively correlated, line 2 of the first channel and line 1 of the second channel are postively correlated, lines 1 from the two channels are uncorrelated, and lines 2 from the two channels are uncorrelated. When two lines are positively correlated, the corresponding XOR gate 170 has a low output and the corresponding counter 180 is decremented, when two lines are negatively correlated, the XOR output is high and the corresponding counter 180 is incremented, and when the two lines are uncorrelated, the XOR output varies and the counter remains near a count of zero.

Figure 8:
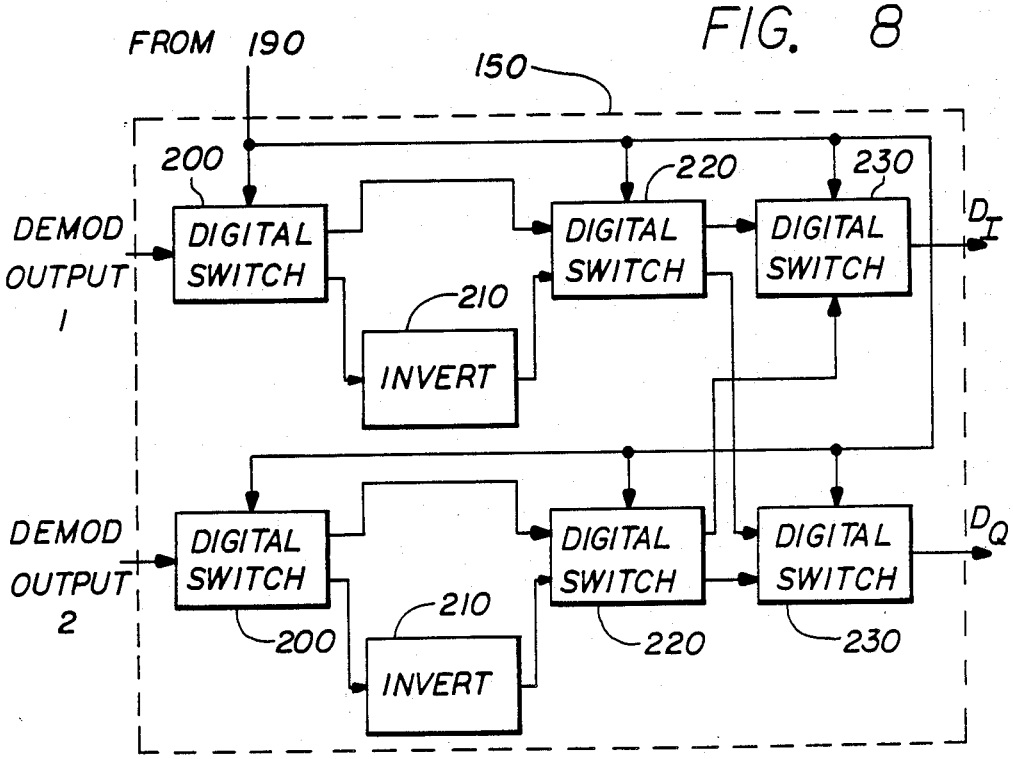
FIG. 8 is a block diagram showing an illustrative implementation of an ambiguity correction circuit.

The decision circuit 190 looks at the count, uses it as an address, looks up the phase angle in memory and provides a two bit output representing the relative phase shift or phase correction to the ambiguity correction circuit 150 shown in FIG. 8.

The ambiguity correction circuit 150 includes digital switch 200, an inverter 210, a second digital switch 220 and a third digital switch 230 for each of the I and Q lines from the second channel 18. The ambiguity correction circuit 150 responds to the output of decision circuit 190 to invert the signals on each line and reverse them as necessary to bring the signals into alignment. The output of the ambiguity detector 140 is also provided to the controller 20 to signal the completion of the phase correction process and the digital switch 160 to switch from the first channel 16 to the second channel 18.

Figure 9:
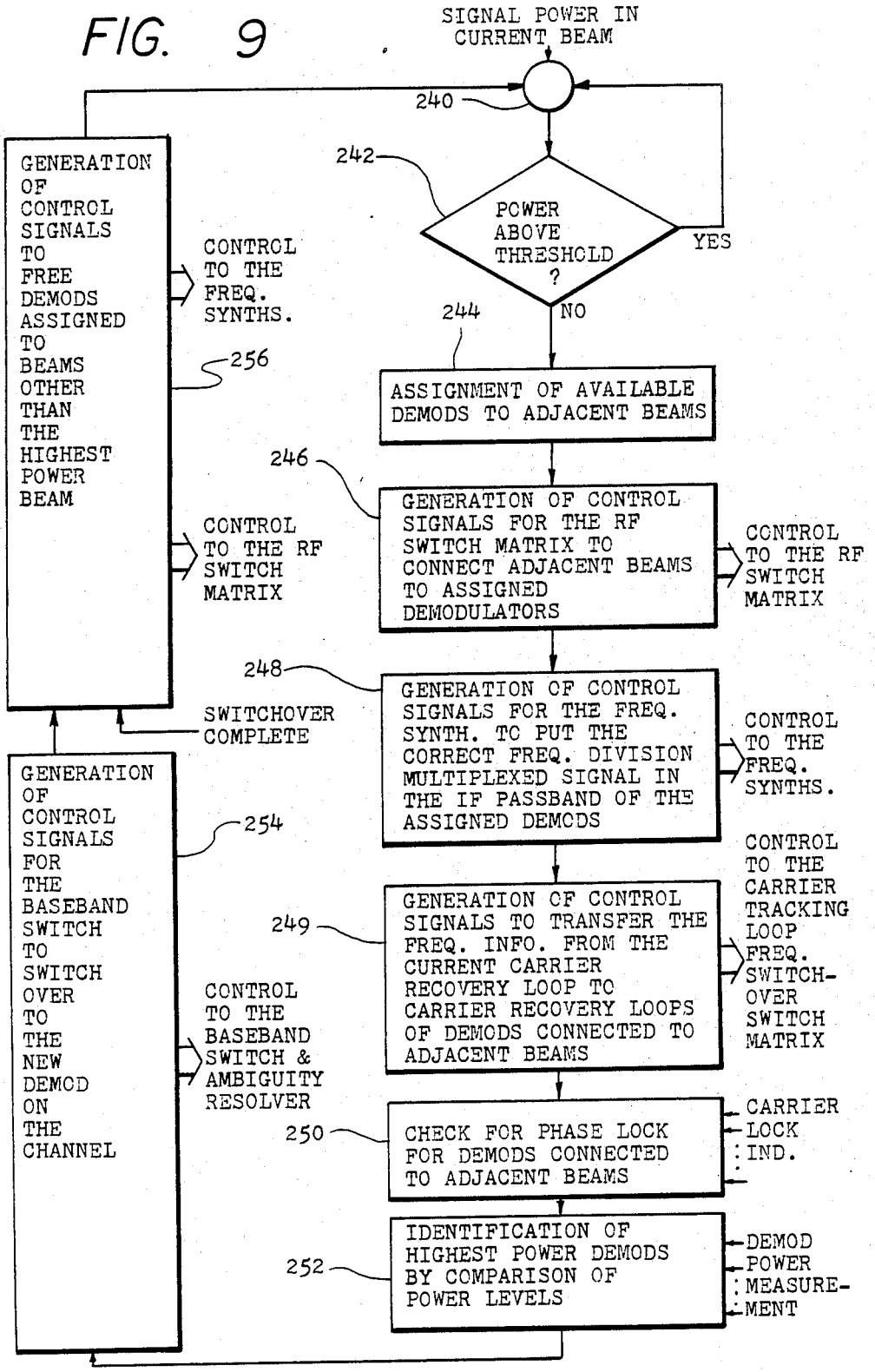
FIG. 9 is a flow chart illustrating the functional operation of the controller of the present invention.
Figure 10:
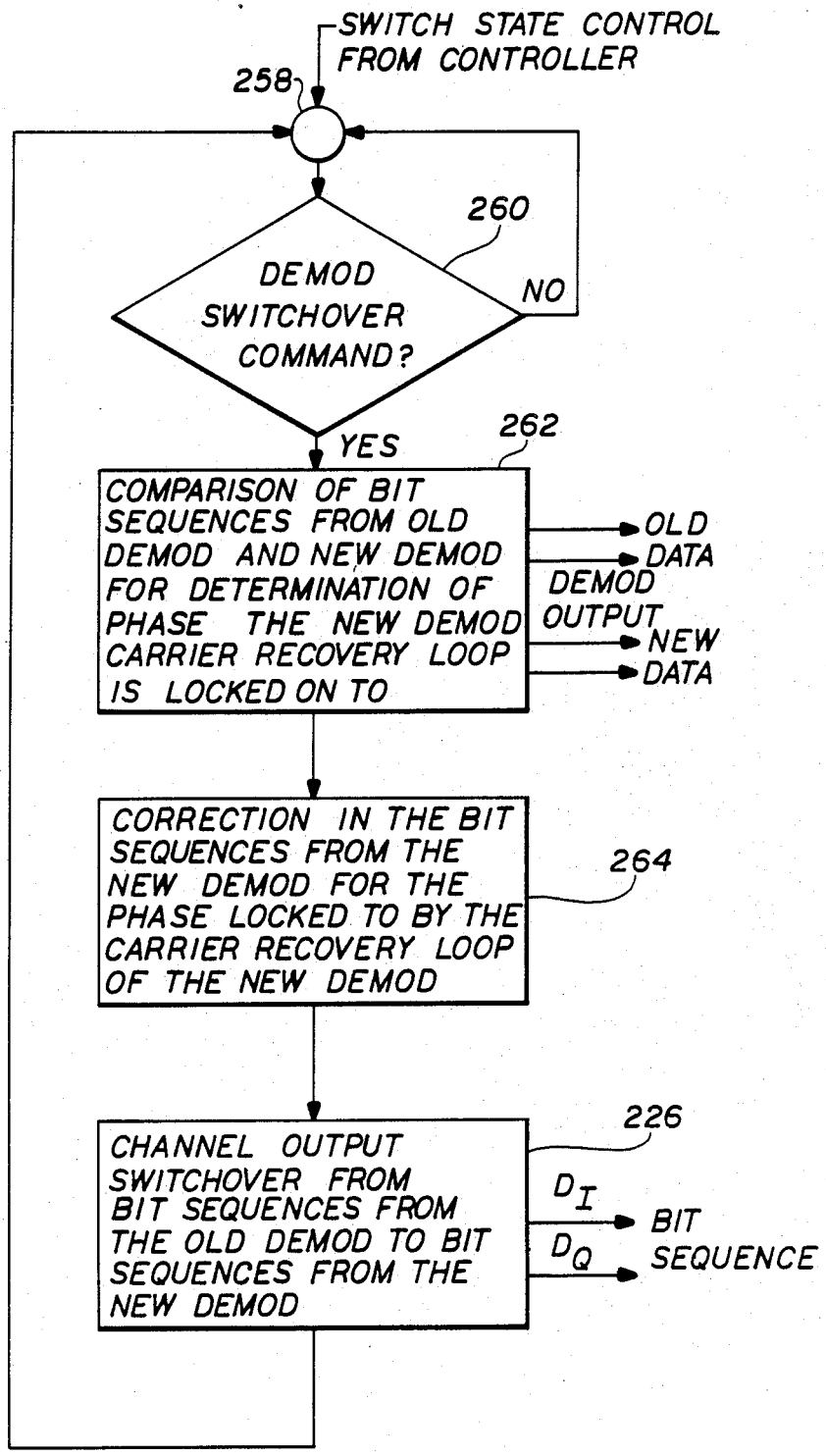
FIG. 10 is a flow chart illustrating the functional operation of the baseband switch of the present invention.

As mentioned above, the controller may be implemented with a microprocessor. The flow diagram of FIG. 9 illustrating the functional operation of the controller 20 is also illustrative with respect to the operation of the present invention. That is, initially, the signal power is in the current beam and the first channel 16. The controller 20 monitors the power level in the channel 16 and predicts the beam switching to be performed at time T. Available demodulators are assigned to adjacent beams and control signals are generated for the RF switch matrix to connect adjacent beams to the assigned demodulation channels. Next control signals are generated to the frequency synthesizers 30 to put the correct frequency division multiplexed signal in the IF passband of the assigned demodulators. Control signals are then generated via the frequency switchover matrix 42 to transfer the frequency information from the current carrier demodulator phase locked loop to the carrier recovery loop of channel selected for the adjacent beam to facilitate rapid carrier acquisition. The controller 20 waits for the loops of the assigned demodulators to lock and then compare the power levels of each to determine which is highest. A channel is chosen based on the power comparison and control signals are generated for the baseband ssitch 120 to switch to the new channel. The flow diagram of FIG. 10 illustrates the functional operation of the baseband switch and ambiguity resolver 120. When the controller 20 signals the switch 120 to switchover, the switch 20 compares the bit sequences from the old channel to the new channel to determine the phase of the new channel in the manner discussed above. The bit sequences of the new channel are corrected per the phase determination and the channels are switched at baseband. When the switchover complete signal is received from the ambiguity detector 140, the controller 20 releases the unused channels and begins to monitor the power in the chosen channel to reiterate the entire process.

While the present inention has been described herein with reference to an illustrative embodiment for a particular application, it is to be understood that the invention is not limited thereto. Those of ordinary skill in the art will recognize additional modifications, applications and embodiments within the scope thereof. For example, although the invention has been described with reference to a QPSK modulation scheme, the invention may be used with other modulation schemes known in the art. Further, as mentioned above, the invention is not limited to any particular channel constitution. The invention is not limited to any particular manner for detecting and resolving phase ambiguity. In fact, depending on the modulation technique employed, phase alignment may not be required. Further, the invention is not limited to either an analog or a digital implementation.

Thus, it is intended by the appended claims to cover any and all such modifications, applications, and embodiments within the scope of the invention.

Accordingly,

What is claimed is:

1. A coherent switching system for a multiple beam antenna comprising:

first channel means connected to a first feed of said antenna, said first channel means having a first demodulator for providing a first baseband signal;

second channel means connected to a second feed of said antenna, said second channel means having a second demodulator for providing a second baseband signal;

power detection means for measuring the power of said first baseband signal;

coherent switching means responsive to said power detection means for switching from said first demodulator to said second demodulator in order to provide switching at baseband from said first baseband signal provided by said first channel to said second baseband signal provided by said second channel; and linear predictive filter means for activating said switching means, said filter means communicatingly connected to said power detector for determining a time at which the switching will occur based on input from said power detector.

2. A coherent switching system for a multiple beam antenna comprising:

first channel means connected to a first feed of said antenna, said first channel means having a first demodulator for providing a first baseband signal and a carrier phase recovery loop for acquiring the phase of said first baseband signal;

second channel means connected to a second feed of said antenna, said second channel means having a second demodulator for providing a second baseband signal and a carrier phase recovery loop for acquiring the phase of said second baseband signal;

power detection means for measuring the power of said first baseband signal; and coherent switching means responsive to said power detection means for switching from said first demodulator to said second demodulator in order to provide switching at baseband from said first baseband signal provided by said first channel to said second baseband signal provided by said second channel.

3. The coherent switching system of claim 2 wherein at least one of said carrier recovery loop means includes injection means for decreasing phase acquisition time of said second channel.

4. A coherent switching system for a multiple beam antenna comprising:

first channel means connected to a first feed of said antenna, said first channel means having a first demodulator for providing a first baseband signal;

second channel means connected to a second feed of said antenna, said second channel means having a second demodulator for providing a second baseband signal;

power detection means for measuring the power of said first baseband signal; and coherent switching means responsive to said power detection means for switching from said first demodulator to said second demodulator in order to provide switching at baseband from said first baseband signal provided by said first channel to said second baseband signal provided by said second channel and including alignment means for aligning in phase said first baseband signal with said second baseband signal prior to the switching thereof.

5. The coherent switching system of claim 4 wherein said alignment means includes phase detection means for detecting phase ambiguity of said second baseband signal relative to said first baseband signal.

6. The coherent switching system of claim 5 further including an output means having phase correction means responsive to said phase detection means for correcting the phase ambiguity of said second signal relative to the phase of said first signal.

* * * * *